United States Patent [19]

Francis et al.

[11] Patent Number: 4,729,817

[45] Date of Patent: Mar. 8, 1988

[54] PROCESS FOR THE OXIDATIVE DELIGNIFICATION OF DEMETHYLATED CHEMICAL PULP

[75] Inventors: Raymond C. Francis, Don Mills; Douglas W. Reeve, Toronto, both of Canada

[73] Assignee: Tenneco Canada Inc. (ERCO division), Islington, Canada

[21] Appl. No.: 810,590

[22] Filed: Dec. 19, 1985

Related U.S. Application Data

[63] Continuation-in-part of Ser. No. 638,013, Aug. 6, 1984, abandoned.

[30] Foreign Application Priority Data

Aug. 1, 1984 [CA] Canada ..... 460161

[51] Int. Cl.[4] ..... D21C 9/00; D21C 9/14; D21C 9/147; D21C 9/16

[52] U.S. Cl. ..... 162/65; 162/78; 162/79; 162/80; 162/84; 162/85; 162/88

[58] Field of Search ..... 162/76, 78, 84, 90, 162/85, 65, 88, 89, 82, 80, 79, 67, 9

[56] References Cited

U.S. PATENT DOCUMENTS 2,882,965 4/1959 Weyman et al. ..... 162/89
4,152,197 5/1979 Lindahl et al. ..... 162/82

FOREIGN PATENT DOCUMENTS 288544 5/1981 U.S.S.R. .

*Primary Examiner*—Steve Alvo
*Attorney, Agent, or Firm*—Sim & McBurney

[57] ABSTRACT

The extent of delignification of chemical pulps by oxygen-containing chemicals, preferably hydrogen peroxide, is enhanced by demethylating the pulp prior to such oxidative delignification, to a degree of demethylation of at least about 30%, preferably at least about 50%. Demethylation may be achieved by chemical treatment of the already-formed pulp or by modification to the pulping process to result in demethylated pulp.

5 Claims, 11 Drawing Figures

EFFECT OF $H_2O_2$ CHARGE ON DELIGNIFICATION

EFFECT OF $H_2O_2$ CHARGE ON DELIGNIFICATION

EFFECT OF $H_2O_2$ CHARGE ON DELIGNIFICATION

EFFECT OF $H_2O_2$ CHARGE ON DELIGNIFICATION

PROCESS FOR THE OXIDATIVE DELIGNIFICATION OF DEMETHYLATED CHEMICAL PULP

REFERENCE TO RELATED APPLICATION

This application is a continuation-in-part of copending U.S. patent application Ser. No. 638,013 filed Aug. 6, 1984, now abandoned.

FIELD OF INVENTION

The present invention relates to improving the efficiency of delignification of pulp during bleaching operations.

BACKGROUND TO THE INVENTION

Chemical pulps as they are produced by the chemical processing of wood chips or the like contain a significant amount of lignin, generally about 2 to about 6 wt %. Such pulps are commonly subjected to bleaching and purification operations in a bleach plant, including delignification of the pulp.

Chemical pulps are generally bleached with chlorine-containing bleaching agents, such as, chlorine, chlorine dioxide and sodium hypochlorite. The effluents from such chlorine-based bleaching processes represent a disposal problem, in that they contain chlorinated organics, have a high biochemical oxygen demand and contain chlorides which inhibit integration with the recovery process of the pulp mill without extensive modification thereto.

Typical of such prior art bleaching operations are those described in U.S. Pat. No. 2,882,965 to Wayman et al wherein there is described the treatment of wood with chlorine, a high temperature caustic extraction and subsequently with chlorine dioxide. A substantial amount of the lignin is removed during the initial chlorine treatment stage and the remaining chlorinated lignin then is removed by caustic extractions.

Hydrogen peroxide is theoretically capable of decreasing the disposal problems posed by chlorine-containing bleaching agents since no chlorinated organics nor chlorides are formed so that the peroxide stage effluent may be taken into the pulping chemical recovery cycle and there destroyed and thus the biochemical oxygen demand is lower. Despite these attractions, hydrogen peroxide has rarely been used, mainly because of its historically high cost. Such cost, however, has been decreasing of late, to the point where there is an interest in using hydrogen peroxide as a substitute for chlorine-based bleaching compounds in the intermediate bleaching stages. However, interest in the utilization of hydrogen peroxide in delignification during the first stage of bleaching has been very small, mainly because oxygen bleaching is much more economical.

One prior art proposal to use hydrogen peroxide delignification involves an initial treatment of the pulp with alkaline hydrogen peroxide to effect partial delignification of pulp prior to bleaching to high brightness with a conventional CEDED sequence using less chlorine. This procedure is the so-called "MINOX" process, described in Tappi Pulping Conference, Preprints (1980), p.325.

SUMMARY OF THE INVENTION

It has now surprisingly been found that oxidative delignification of chemical pulp, such as, kraft pulp, soda pulp or sulfite pulp, can be significantly improved by increasing the degree of demethylation of the pulp prior to the delignification. Such demethylation may be effected by chemical treatment of already-formed chemical pulp or may be effected by suitable modification of the conditions of pulping to produce a demtheylated pulp.

The invention has particular application to hydrogen peroxide delignification but is also applicable to other forms of oxidative delignification, using other oxygen-containing reagents, including oxygen, chlorine dioxide and peracetic acid.

The term "chemical pulp" as used herein, refers to the product of manufacture of wood pulp from raw wood primarily by chemical means well known to those skilled in the art. Chemical pulps are formed by the removal of lignin from wood chips by chemical action to form a fibrous pulp. The pulp fibres still contain substantial quantities of lignin, general about 2 to about 6 wt. % of the pulp.

GENERAL DESCRIPTION OF INVENTION

Figure 1:
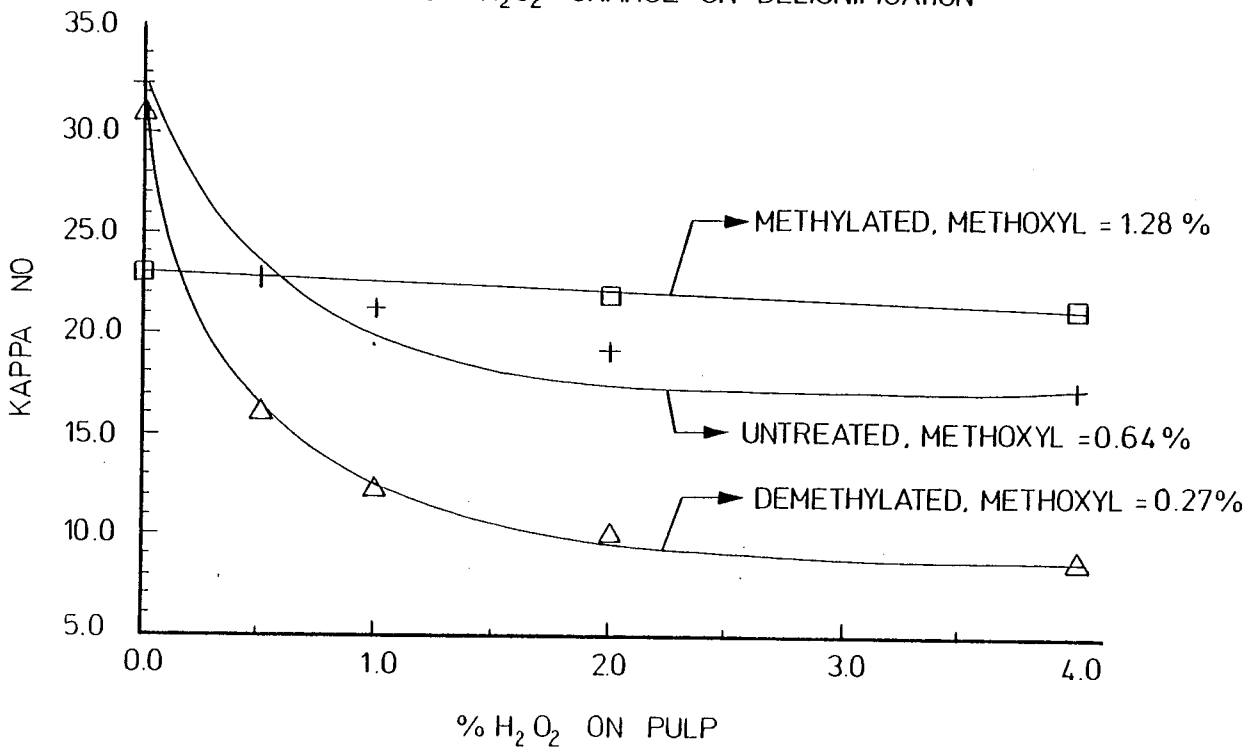
FIGS. 1 to 11 of the accompanying drawings are graphical representations of the results of delignification experiments.

Lignin is the major noncarbohydrate constituent of wood and, prior to chemical pulping, usually comprises about one-quarter of the raw material, functioning as a binder for the cellulosic fibres. Significant quantities of the lignin are removed during chemical pulping to form the fibrous pulp. Substantial quantities of lignin remain, however, and one of the purposes of bleaching procedures is to remove the residual lignin by degradation and solubilization with bleaching chemicals and extraction with alkali, so as to provide a pulp which is stable as to brightness and strength.

Chemically, lignin is a complex structure which varies depending on the species of wood but is characterized by the presence of methoxyphenyl groups. We have found that if demethylation of such groups is effected so as to produce greater numbers of phenolic groups prior to oxidation treatment, then the degree of delignification which can be achieved in the oxidative delignification is significantly increased.

The demethylation may be effected in any convenient manner which breaks the methoxy bond and forms the phenolic group. Procedures which may be used include treatment with Lewis acids or other electron-deficient compounds, such as aluminum chloride, boron tribromide or trimethyl silyl iodide or with nucleophiles which attack the methyl group by the $SN_2$ mechanism and breaks the oxygen-methyl bond, such as organic and inorganic sulfides, and other reagents with an unshared pair of electrons, such as, thiosulfate, sulfite, iodide, bromide and chloride ions and phosphides. Such demethylation may be effected following pulp formation and prior to the oxidative treatment or, alternatively, suitable modification of the pulping procedure may be made to result in pulp containing demethylated lignin.

Softwood lignins have a methoxyl content before pulping of around 16%, while the corresponding value for hardwood lignin is around 22%. In a typical kraft process digestion operation performed at 160° to 170° C., the extent of demethylation is only about 10% for softwood kraft pulps.

The extent of demethylation is defined as:

$$(1-m)\times 100\%$$

where m is equal to the methoxyl content of lignin in pulp, divided by the methoxyl content of lignin before pulping. The methoxyl content is determined according to TAPPI method T209 SU-69. For kraft pulps, the lignin content is approximately 0.13%×k (Kappa No.). The extent of demethylation is similarly around 10% for softwood sulfite and softwood soda pulps. There is very little data available on hardwood pulps.

In the present invention, this natural degree of demethylation is increased by the procedures described herein. Our results with softwood kraft pulps have shown that an extent of demethylation greater than 30% is required for significantly improved delignification with hydrogen peroxide. In the present invention, a "demethylated pulp" is defined as one having an extent of demethylation greater than about 30%. Preferably, the demethylated pulps have an extent of demethylation greater than about 50%.

The extent to which demethylation can be achieved depends on the identity of the demethylating agent employed, the species of wood and the conditions of demethylation. Demethylation procedures generally involve adding the demethylating reagent along with the wood pulp in an appropriate solvent. The ratio of demethylating reagent to wood pulp depends on the nature of the demethylating reagents and the temperature of the reaction. The demethylation procedure is generally completed by purifying the wood pulp, for example, by washing the pulp free of any residual quantities of the demethylating agent.

Although, as far as the applicants are aware, the prior art has nowhere previously described demethylation of pulp, as is involved in this invention, there have been descriptions of demethylation of extracted purified lignin, generally involving sulfur-containing nucleophiles in aqueous solution at temperatures greater than 150° C. Such a procedure is described in U.S. Pat. No. 3,948,801. Chlorine gas (U.S.S.R. Pat. No. 288,544) and N-butylamine hydrochloride (U.S. Pat. No. 4,250,088) also have been reported for lignin demethylation. In developing demethylation procedures for pulps, as set forth herein, carbohydrate interference and preservation have to be taken into account as has the potentially lesser accessibility of the lignin in the pulp.

The demethylation reaction which is effected in the present invention, as noted above, involves removal of methoxyl groups from the lignin present in the chemical pulp being treated. The process does not involve any significant degree of delignification and it is only upon the subsequent application of the oxidative delignification chemical does any significant degree of delignification occur.

The procedure to which the present invention relates, therefore, is an enhancement of oxidative delignification of wood by initially providing the pulp in an increased demethylated form in comparison with its normal form. The process of this invention, therefore, is quite distinct from those processes wherein direct delignification of the pulp occurs, for example, in a conventional first stage bleaching operation using chlorine-containing chemicals, such as is described in the Wayman et al patent discussed above. While it is highly likely that demethylation of the lignin will occur during the Wayman bleaching treatment, at the same time, the lignin is degraded by the bleaching chemical and is removed, so that after caustic extraction, the residual lignin content usually is less than 1%. Whether or not demethylation occurs is immaterial to the Wayman et al process since delignification occurs. In contrast, the present invention specifically requires the discrete step of an initial demethylation of the pulp before oxidative delignification is effected, preferably with hydrogen peroxide.

The present invention is also contrasted with processes in which high yield pulps are intended as the final product wherein a substantial proportion of the original lignin is retained within the pulp, as described, for example, in U.S. Pat. No. 4,152,197 to Lindahl et al. This patent describes the production of high yield cellulosic pulps, in the range of 70 to 93% of the original wood, by mechanical defibration of mixtures of two portions of particulate lignocellulosic material, one of which has been softened more than the other. Such pulps, which are the end product for intended use, generally have a high proportion of the original lignin material retained with the cellulose fibres. In the Lindahl et al process, one portion of the original wood is pulped to a mild degree using sodium hydroxide before mixing with the other portion. The pulp may be bleached with hydrogen peroxide to the final brightness level by removal of chromophores. Such removal of chromophores is effected without the removal of lignin, which would be contrary to the intention in Lindahl et al. In the present invention, delignification is effected by hydrogen peroxide and such demethylation is enhanced by providing the pulp initially in a decreased demethylated form.

The oxidative delignification of the demethylated pulp may be effected with any convenient oxygen-containing delignification agent, for example, hydrogen peroxide, molecular oxygen, chlorine dioxide and peracetic acid.

The oxidative delignification treatment of the demethylated pulp may be effected under any convenient conditions as known in the art, depending on the identity of the delignification agent. Oxidative delignification using hydrogen peroxide usually is effected at a consistency of about 3 to about 20%, a pH of about 10 to about 13, a time of about 0.5 to about 2 hours, at a temperature of about 70° to about 100° C. using a charge of hydrogen peroxide of about 0.1 to about 4.0% on pulp.

Oxidative delignification using oxygen usually is effected at a consistency of about 3 to about 30%, a pH of about 10 to about 13, a time of about 10 to about 60° minutes, a temperature of about 80° to about 120° C. using a consumed charge of oxygen of about 0.2 to about 3.0% on pulp.

Oxidative delignification using chlorine dioxide usually is effected at a consistency of about 3 to about 20%, a pH of about 1 to about 4, a time of about 30 to about 120 minutes, a temperature of about 60° to about 90° C. using a charge of chlorine dioxide of about 0.5 to 2.0% on pulp.

In experiments conducted to date, the demethylation treatment has been found to be particularly effective in enhancing oxidative delignification using hydrogen peroxide. The process of the invention has application to a wide variety of woods, including both softwood and hardwood species.

Since the provision of demethylated pulp as the starting point for oxidative delignification enables greater delignification to be achieved with the same amount of oxidation chemical, then the same degree of delignification may be achieved with lesser amounts of oxidation chemical.

The overall degree of delignification which can be achieved using the present invention is considerably greater than can be achieved using oxidation of non-demethylated pulp, so that the extent of delignification which needs to be effected in the later stages of the bleaching process is decreased. In this way, the overall quantity of bleaching chemical which needs to be employed is decreased and hence the overall cost of bleaching pulp may be decreased.

EXAMPLES

EXAMPLE 1

Samples of softwood kraft pulp of Kappa no. 32.5 were treated to effect both methylation and demethylation. The pulp initially has an average methoxyl content of 0.64 wt. % (as determined by TAPPI Method T209 su-69).

Methylation was conducted on 18 g of pulp at 3% consistency in a 1000 ml beaker with a four neck cover. The beaker was equipped with a mechanical stirrer and an electrode from a pH meter. Vigorous stirring was applied and dimethyl sulfate was added at approximately 0.5 to 1.0 ml/min. from a burette. From another burette, 2 drops of 30% NaOH were added whenever the pH fell to 8.0, which raised the pH to 10.0. The experiment was done at approximately 25° C. and under a nitrogen atmosphere with 50 ml of dimethyl sulfate on 18 g of pulp. The methoxyl content was found to be increased to 1.28 wt. %.

Demethylation was effected using potassium thiopenoxide, which was prepared by reacting potassium metal with thiophenol in tetrahydrofuran (THF). THF was evaporated off and diethylene glycol and pulp added. Demethylation was conducted on 18 g of moisture free pulp at 3% consistency in a 1000 ml beaker with a four neck cover. The beaker was placed in a heating mantle and equipped with a mechanical stirrer, a condensor and a thermometer. After the diethylene glycol and pulp were added, the slurry was stirred and heated to 220° C. and maintained at that temperature for another 20 minutes. The entire experiment was conducted under a nitrogen atmosphere. 9.6 ml of thiophenol with the appropriate amount of potassium metal (3 g, approximately 90% of the stoichiometric requirement) were used with the 18 g of pulp and resulted in a pulp having an average methoxyl content of 0.27 wt. %.

Samples of methylated, demethylated and untreated pulp were subjected to alkaline peroxide delignification treatment at various concentrations of hydrogen peroxide up to about 4% $H_2O_2$ on pulp. Other conditons of the treatment were 80° C., 3% NaOH on pulp, pH 12+, 2 hours and 10% consistency. Kappa and hypo nos. were determined for the various pulp samples, both before and after hydrogen peroxide treatment, and the values were plotted graphically (see FIGS. 1 and 2).

The lignin content of the samples, along with untreated samples and methylated samples, was determined both in terms of Kappa nos. and hypo number to avoid any interference in the results by methylation and demethylation. (It is well known that chlorine, as used in the hypo number tests, is not influenced by the presence or absence of methoxyl groups in the lignin structure).

Figure 2:
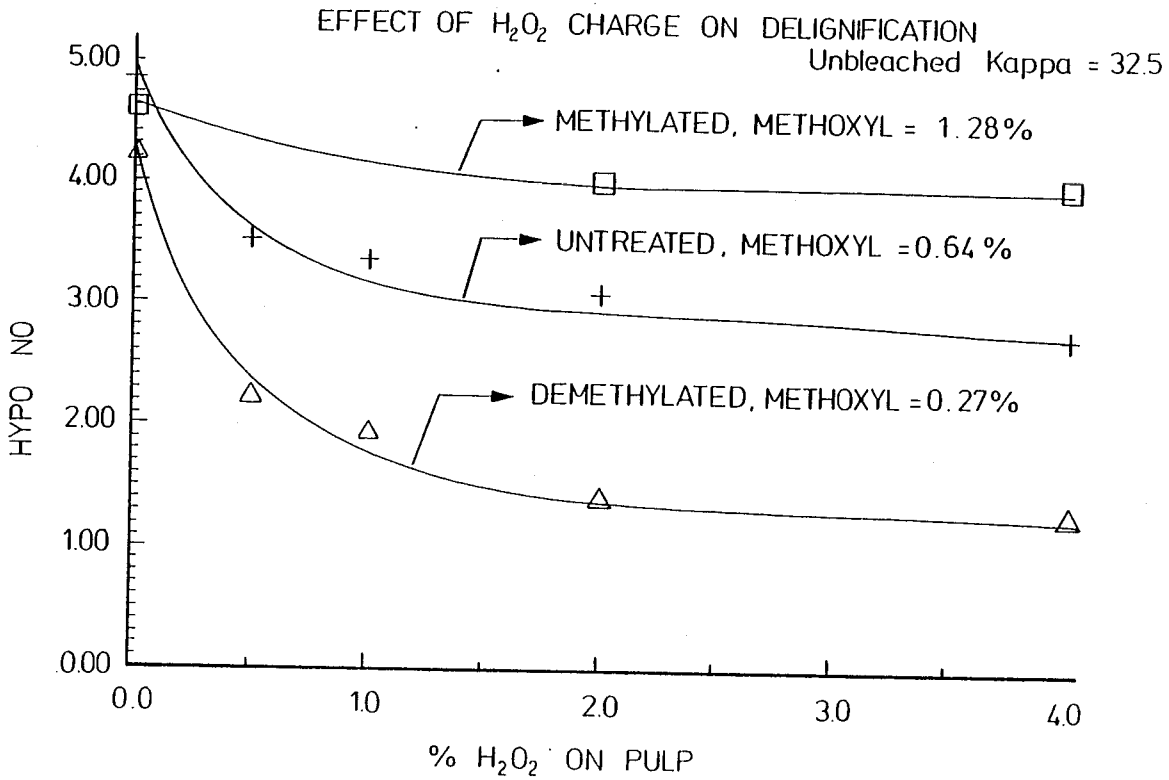

As may be seen in FIGS. 1 and 2, demethylation of the pulp significantly increased the degree of delignification as compared to the untreated pulp, which was delignified only to a limited degree. In addition, methylation decreased the degree of delignification of the pulp which was achieved.

EXAMPLE 2

The demethylation procedure of Example 1 was repeated with certain modifications to the process conditions. In this Example, 150% of the stoichiometric amount of potassium was used, excess potassium was removed after 1 hour and 2 ml of thiophenol added for a further 15 minutes, 20 g of pulp were used instead of 18 g, treatment was effected for 30 minutes at 200° C. in place of 20 minutes at 220° C., and, after demethylation, the pulp was washed with large quantities of water and given four twenty-minute washes with $H_2SO_3$ at pH 1.2. Methoxyl analysis showed an average content of 0.22%.

The Kappa nos. for the demethylated pulp samples were determined and plotted graphically. The resulting curve, superimposed on the curve for the results of Example 1, is reproduced as FIG. 3.

EXAMPLE 3

Figure 3:
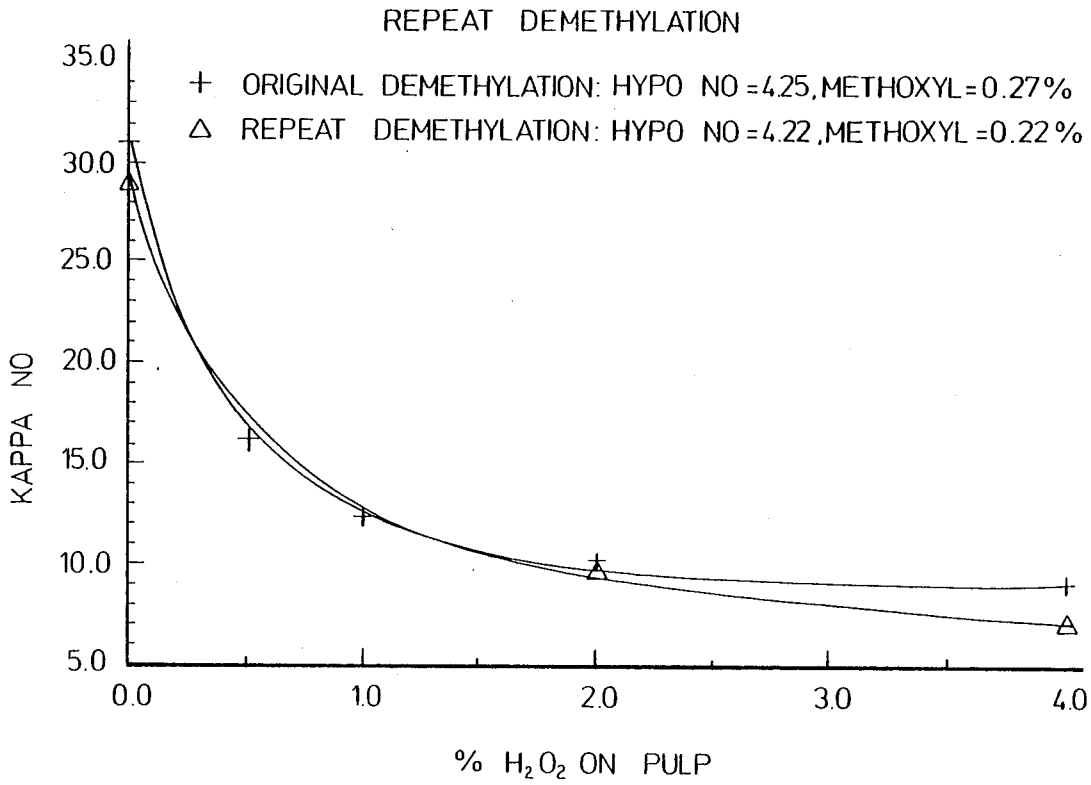
Figure 4:
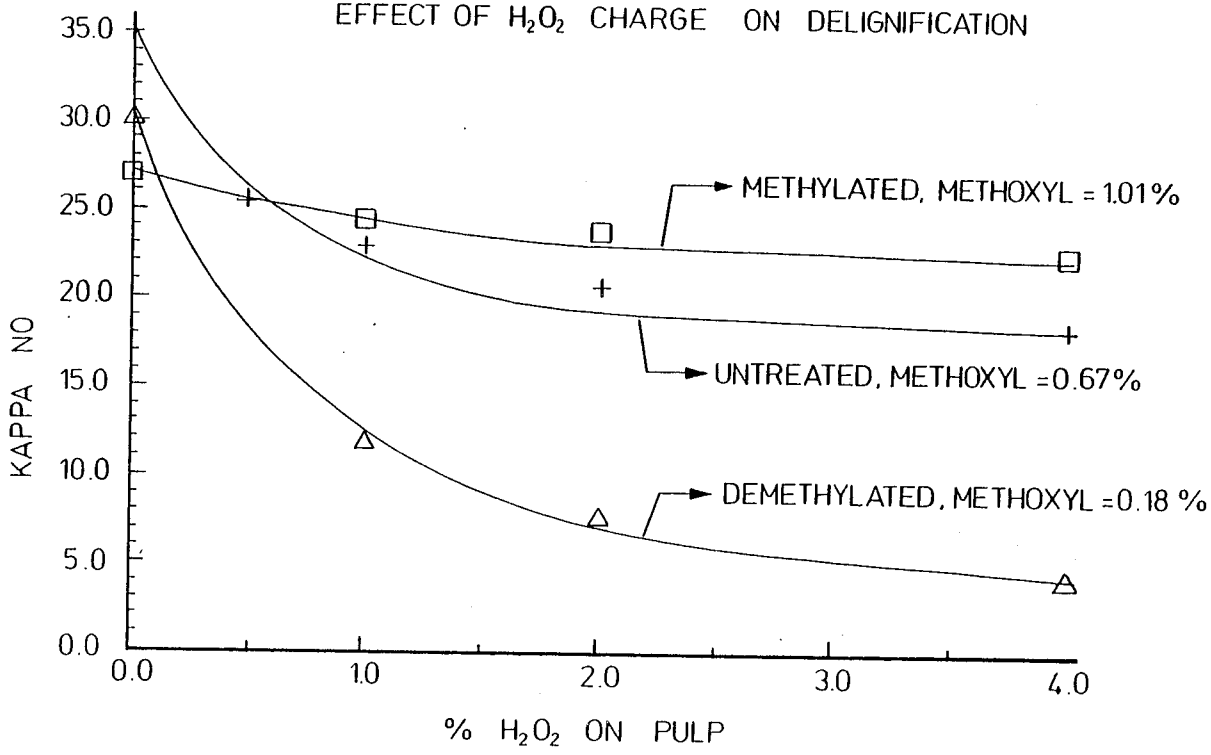
Figure 5:
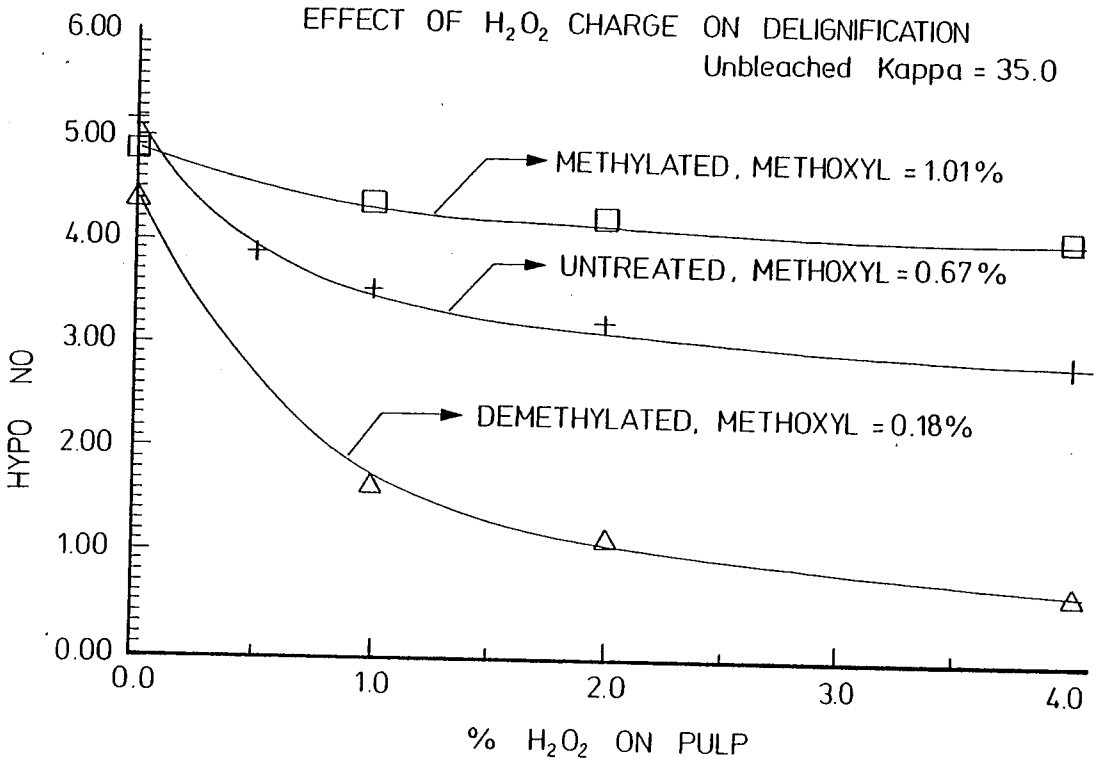
Figure 6:
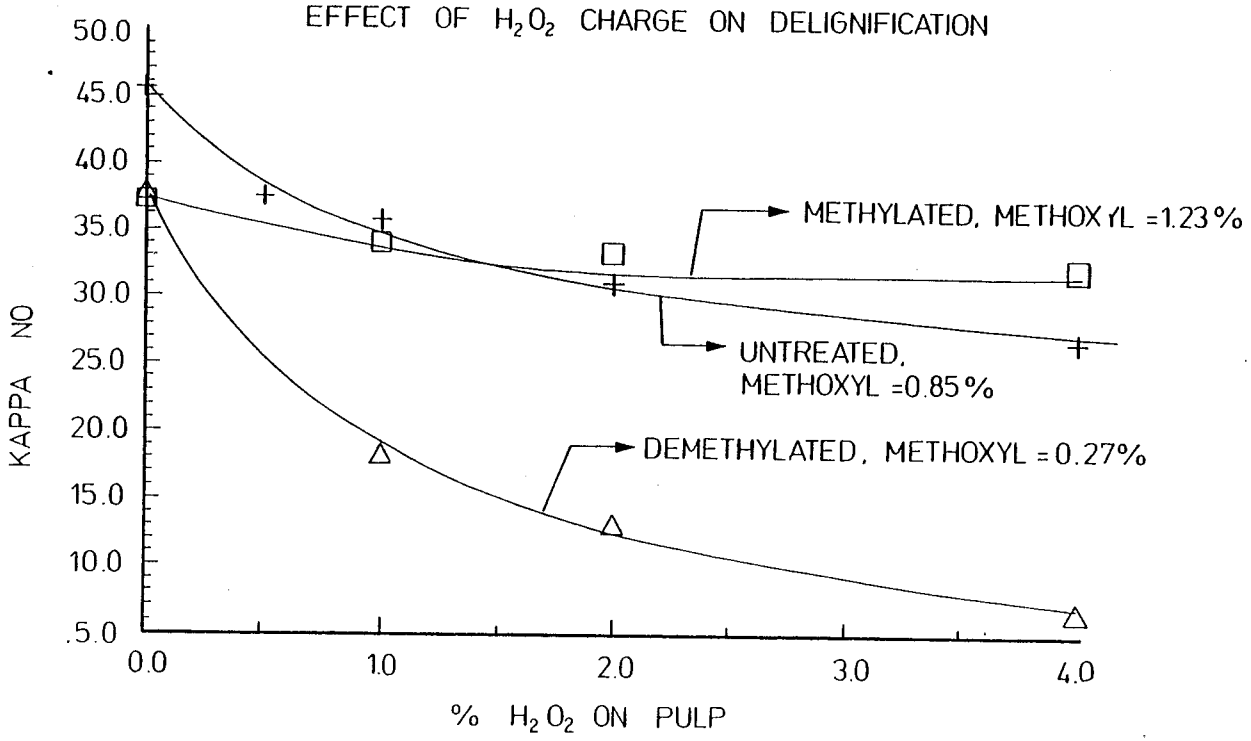
Figure 7:
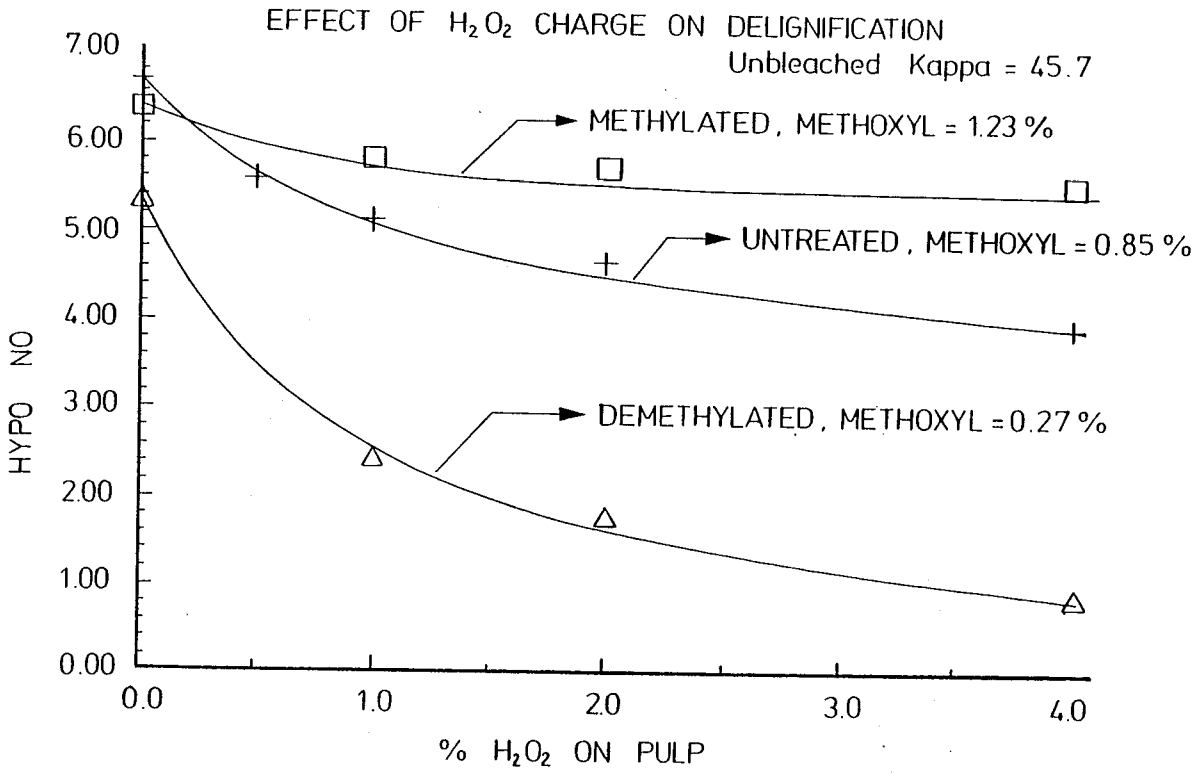
Figure 8:
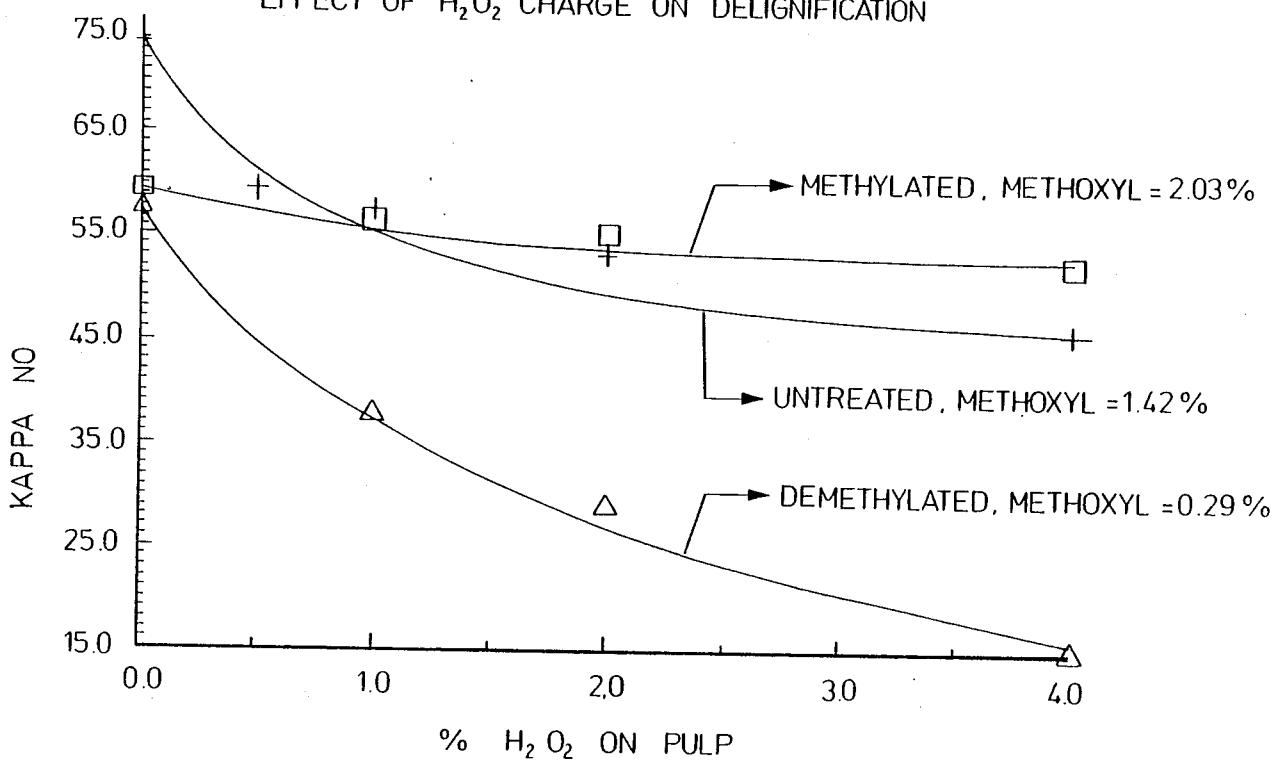
Figure 9:
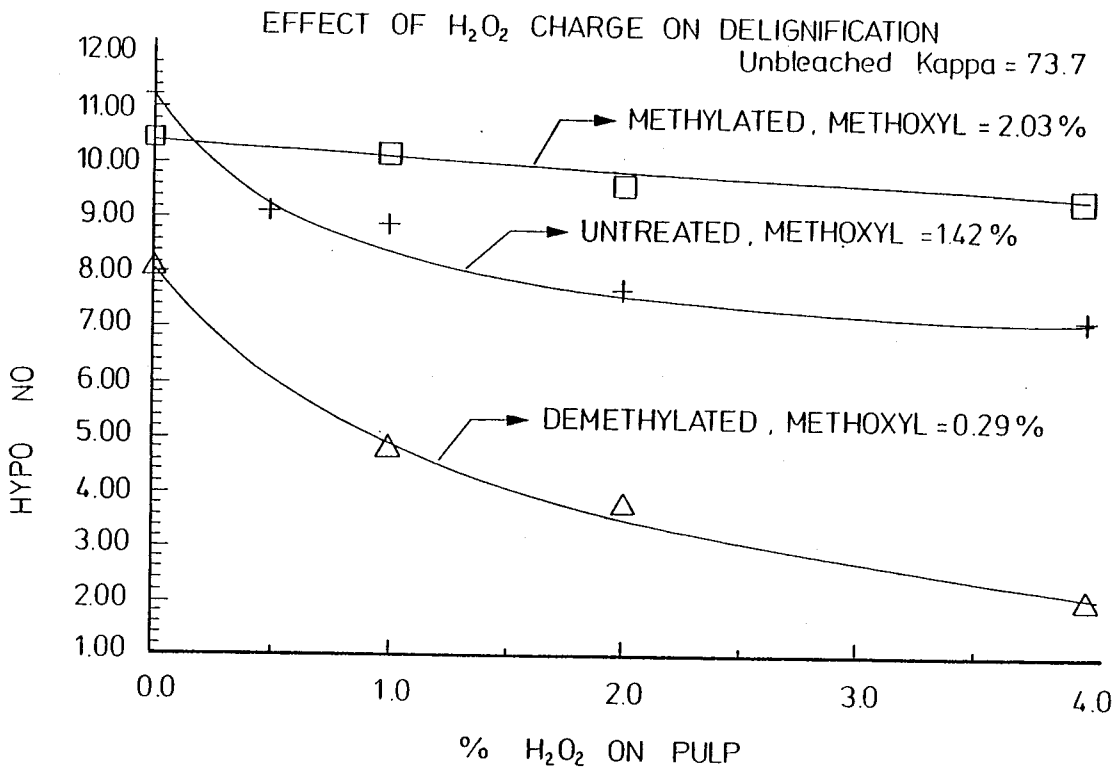

The procedures of Examples 1 and 2 were repeated on two other softwood kraft pulps, respectively of 35 Kappa no. and 45 Kappa no., and a softwood soda pulp of 73 Kappa no. The results of hydrogen peroxide delignification in each case were plotted graphically in terms of Kappa no. and hypo number and the results appear in FIGS. 4 to 9 respectively. The same results in terms of improved delignification by demethylation as appear in FIGS. 1 to 3 are seen in FIGS. 4 to 9, demonstrating that the process is not limited to any specific pulp.

EXAMPLE 4

The procedures of Examples 1 and 2 were repeated, except that chlorine dioxide is substituted for hydrogen peroxide. In this instance, the demethylated pulp had a methoxyl content of 0.18% and chlorine dioxide solution treatment was effected at a 3% consistency, 60% and pH 1.5 to 2.0 for thirty minutes and was followed by a caustic extraction stage effected at 12% consistency, 70° C. and an end pH of 11+ for 2 hours.

Figure 10:
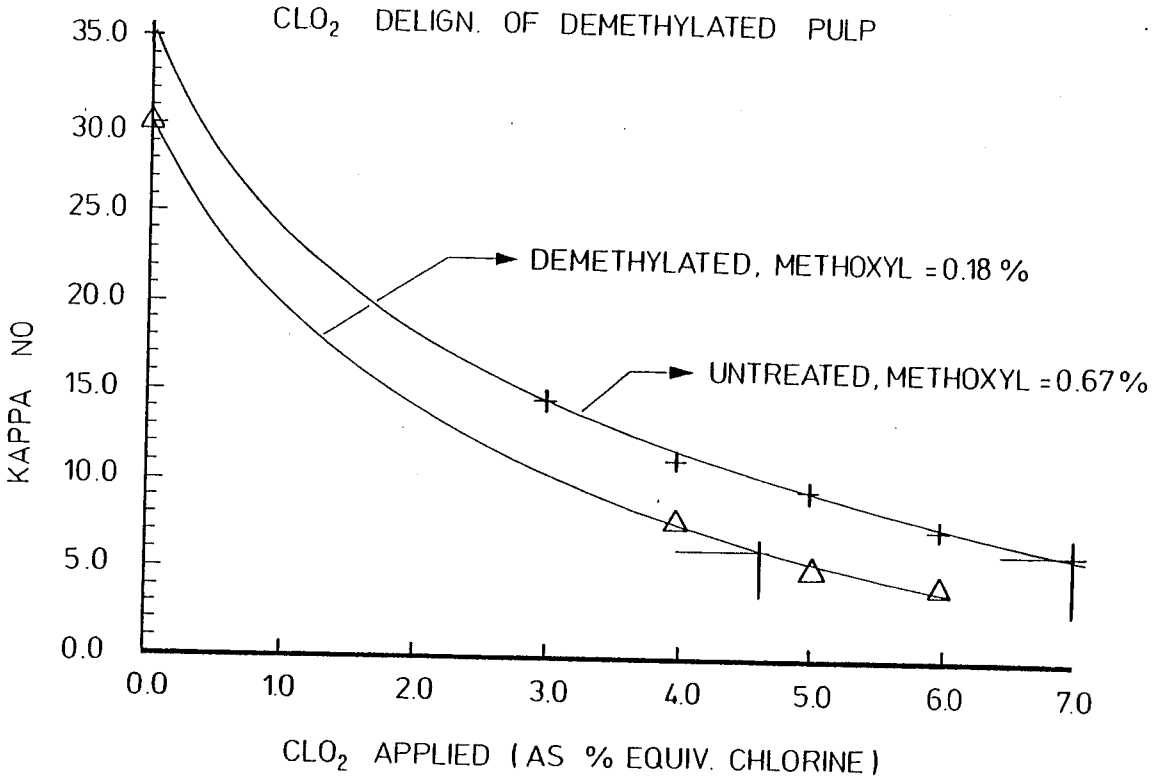
Figure 11:
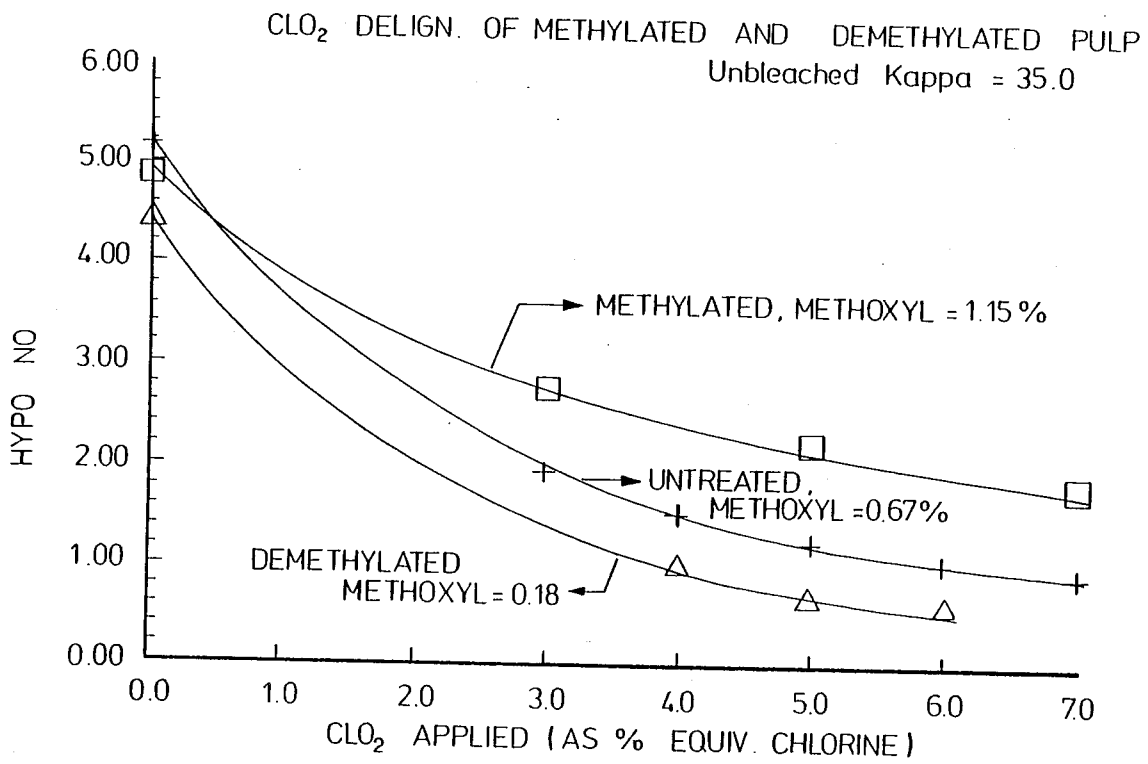

The delignification results obtained for chlorine dioxide-treated pulp and also for untreated pulp were plotted graphically both for Kappa no. and hypo number and the respective curves appear as FIGS. 10 and 11. As may be seen therefrom, demethylation of the pulp improves the delignification which can be achieved using chlorine dioxide treatment but not to the same extent as hydrogen peroxide under the conditions of testing.

SUMMARY OF DISCLOSURE

In summary of this disclosure, the present invention provides an improved process of oxidative delignification wherein provision of the chemical pulp in a demethylated form increases the degree of delignification which is achieved. Modifications are possible within the scope of this invention.

What we claim is:

1. A process for the oxidative delignification of chemical pulp, which comprises:

forming a chemical pulp containing about 2 to about 6 wt. % of lignin from wood by a kraft process, a soda process or a sulphite process, chemically demethylating the lignin content of said chemical pulp with an electron-deficient compound selected from the group consisting of aluminum chloride, boron tribromide and trimethylsilyl iodide or a nucleophile selected from the group consisting of organic and inorganic sulfides, reagents containing thiosulfate, sulfite, iodide, bromide or chloride ions, and phosphides, without effecting any substantial delignification of said chemical pulp during said chemical demethylation of the lignin so as to provide lignin in said chemical pulp with a degree of demethylation of at least about 30%, and thereafter subjecting said demethylated pulp to oxidative delignification by contact with an oxidative delignification agent.

2. The process of claim 1 wherein said pulp has a degree of demethylation of greater than about 50%.

3. The process of claim 1 wherein said oxidative delignification agent is hydrogen peroxide.

4. A process of forming delignified chemical wood pulp, which comprises:

forming a chemical wood pulp having a lignin content of about 2 to about 6 wt. % by pulping wood using pulping chemicals, chemically demethylating the lignin content of said pulp without effecting any substantial delignification of the pulp using an electro-deficient compound or a nucleophile to a degree of demethylation of at least about 30%, and oxidatively delignifying said chemical wood pulp using an oxidative delignification agent selected from the group consisting of hydrogen peroxide, molecular oxygen, chlorine dioxide and peracetic acid.

5. The process of claim 4 wherein said pulp has a degree of demethylation of at least about 50%.

* * * * *